US006992558B1

(12) United States Patent
Vallen

(10) Patent No.: US 6,992,558 B1
(45) Date of Patent: Jan. 31, 2006

(54) ELECTRIC BALLAST

(75) Inventor: Jacobus W. Vallen, Oss (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 1310 days.

(21) Appl. No.: 09/224,913

(22) Filed: Jan. 4, 1999

(30) Foreign Application Priority Data

Jan. 30, 1998 (EP) ..... 98200271

(51) Int. Cl.
*H01F 27/30* (2006.01)

(52) U.S. Cl. ..... 336/209

(58) Field of Classification Search ..... 336/96, 336/90, 192, 198, 209, 206–208, 199
See application file for complete search history.

(56) References Cited

U.S. PATENT DOCUMENTS 1,797,768 A * 3/1931 Goad ..... 336/209
2,902,661 A * 9/1959 Henderson ..... 336/209
3,378,800 A 4/1968 Liberman ..... 336/192
3,939,450 A * 2/1976 Donnelly ..... 336/90
4,222,023 A 9/1980 Beech ..... 336/209
4,291,292 A * 9/1981 Witchger ..... 336/192
4,363,014 A * 12/1982 Leach et al. ..... 336/90
4,424,505 A * 1/1984 Yatsushiro et al. ..... 336/90
4,916,363 A * 4/1990 Burton et al. ..... 315/276
4,988,968 A * 1/1991 Tochio et al. ..... 336/98
5,153,550 A * 10/1992 Sugiura et al. ..... 336/192

FOREIGN PATENT DOCUMENTS

EP 0018596 B1 7/1984

* cited by examiner

*Primary Examiner*—Tuyen T Nguyen
(74) *Attorney, Agent, or Firm*—Larry Liberchuk

(57) ABSTRACT

An electric ballast 1 is provided with an electric coil with windings having a width d which are wound on a synthetic resin coil base 10 comprising a box-like base part 11 of rectangular shape having four faces 111, 112, 113, 114. The base part is suited to accommodate an iron core of the coil. The base part is provided on either side with mutually parallel flanges 121, 122 which define the width d.

The ballast is provided with a separate, insulating synthetic resin cover which is in one piece and which, when positioned in engagement with the coil base, cooperates therewith to substantially completely enclose the coil windings.

3 Claims, 4 Drawing Sheets

ELECTRIC BALLAST

BACKGROUND OF THE INVENTION

1. Field of the Invention

This invention relates to an electric ballast comprising an electric coil with coil windings having a width d which are wound on a synthetic resin coil base including a box-like base part comprising four faces arranged so as to form a rectangle for accommodating a metal core, said base part being provided on either side with mutually parallel flanges limiting the width d of the coil windings.

2. Description of the Related Art

An electric ballast of the type mentioned in the opening paragraph is known from EP-0 018 596. This known ballast can suitably be used, inter alia, as a ballast for an electric discharge lamp. In said known ballast, the coil base comprises lamellae which, after providing the coil windings, are turned over and secured with a free end to the base part so as to completely enclose the coil windings. The base part and the lamellae are made of an insulating synthetic resin and are manufactured in a single piece. Turning over the lamellae requires the presence of folding seams at the location where the lamellae meet the base part. This constitutes a drawback.

SUMMARY OF THE INVENTION

The invention provides a measure for obviating said drawback. An electric ballast of the type mentioned in the opening paragraph is characterized in accordance with the invention in that the coil is provided with a separate insulating synthetic resin cover, which is in one piece and which, in co-operation with the coil base, encloses the coil windings.

In the case of the ballast in accordance with the invention, a separate one-piece synthetic resin body is used which externally encloses the coil windings, as a result, folding seams in the synthetic resin of the base part are no longer necessary. This has a large number of important advantages. A first advantage is that the base part and the cover may be manufactured from a different type of synthetic resin. For example, the base part, which serves as a support, may be made of a glass-filled synthetic resin which, on the one hand, is brittle and hence unsuited to be turned over but which, on the other hand, has a high rigidity. By virtue thereof, a thin-walled base part can be used which enables the coil windings to better fill the volume occupied by the coil base. This has a favorable effect on the efficiency of the ballast and on the volume thereof. The cover may be made of unfilled synthetic resin.

Another advantage is that in the case of a coil base which accommodates not only supply-voltage windings for feeding the lamp but also high-voltage windings, a thin-walled base part having increased insulation properties is possible, the high-voltage windings being provided near the faces thereof, and the supply-voltage windings being provided near the cover. This is favorable, inter alia, from the point of view of safety.

A further advantage of the invention is in that both the cover and the coil base may each have a substantially constant wall thickness. This generally leads to a more efficient production cycle in the manufacture of the relevant synthetic resin products in batches on an industrial scale. The coil base of the ballast in accordance with the prior art, however, will exhibit a substantial reduction in wall thickness at least at the location of the folding seams. As a result, there is a substantial spread in the curing time of the synthetic resin.

In addition, the invention leads to an important efficiency improvement of the coil manufacture in that, in the case of the inventive ballast, after the provision of the coil windings on the coil base, only the single cover has to be provided, two ends of which are connected to each other. Unlike this, in the case of the known ballast, after the provision of the coil windings on the coil base, 6 lamellae must be turned over and at least two of said lamellae must be secured to the base part. This does not only involve a larger number of operations, but also the sequence in which the various lamellae are turned over is to be observed.

Further, the measure is also advantageous as regards the tools necessary for manufacturing the ballast, since, in the case of the invention, during winding, the tools only have to retain the coil base without the necessity of keeping additional lamellae outside the winding field. This results in the use of simpler tools.

In an advantageous embodiment of the ballast in accordance with the invention, the coil base is provided with a member for forming a connection member for connecting an external electrical connection, and the cover also forms an external insulation of said connection member. In this very simple manner, both a safe connection of the coil to an electric circuit accommodating the ballast is obtained and the cover is positioned in a defined manner relative to the coil base.

In a further embodiment of the ballast in accordance with the invention, the cover is provided with end portions which are connected to each other. The end portions may be bonded together by means of an adhesive, however, preferably they are interconnected by means of a snap connection.

These and other aspects of the invention will be apparent from and elucidated with reference to the embodiments described hereinafter.

DESCRIPTION OF THE PREFERRED EMBODIMENTS

Figure 1A:
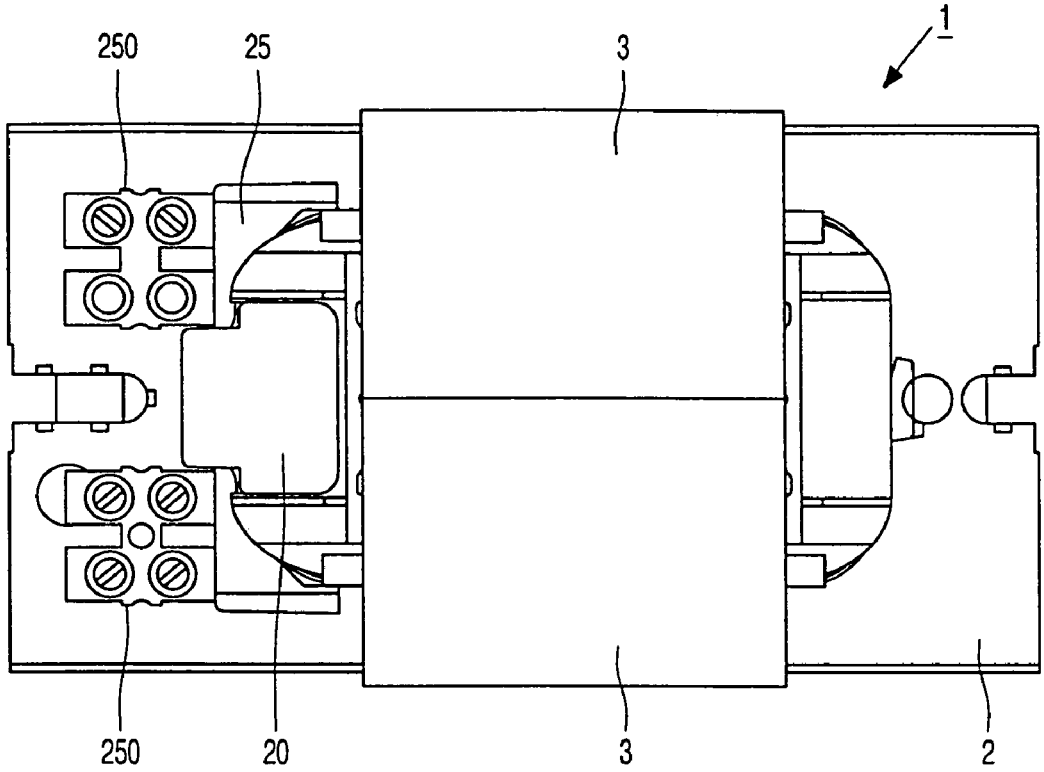
FIGS. 1A,B are a plan view and a side view, respectively, of an electric ballast in accordance with the invention, FIGS. 2A,B are a plan view and a side view, respectively, of a synthetic resin coil base with a box-like base part of the electric ballast in accordance with FIG. 1, FIGS. 3A,B are a side view and a plan view, respectively, of a cover of the electric ballast in accordance with FIG. 1.
Figure 1B:
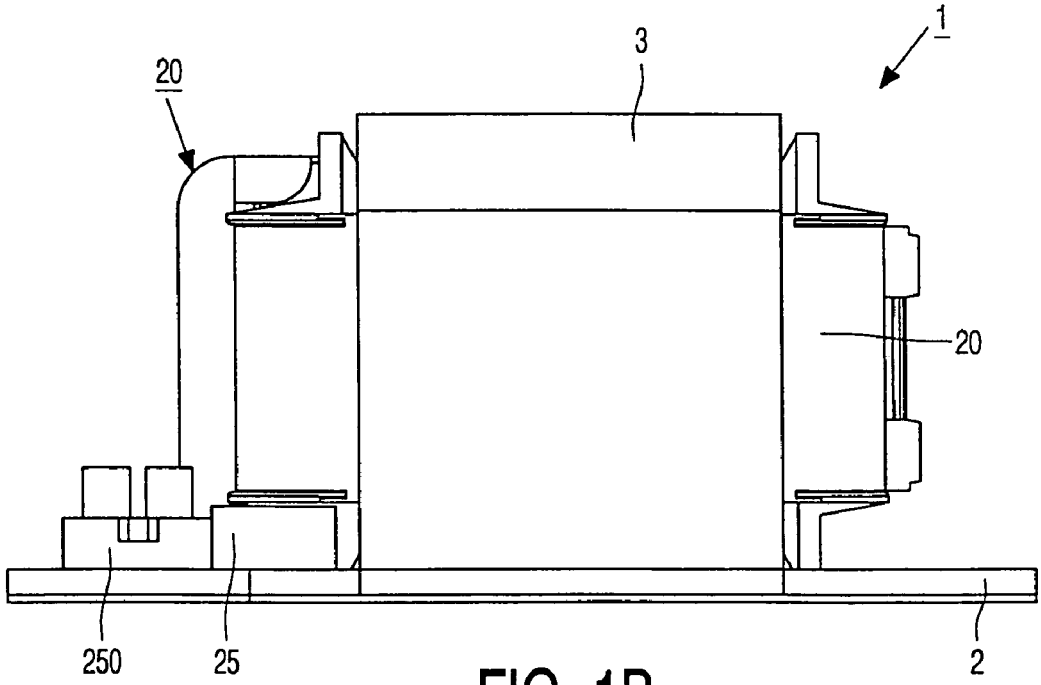

In FIGS. 1A and 1B, an electric ballast 1 is provided with a housing formed by a cover plate 2 mounted on an external sheet stack 3. A coil incorporated within the ballast is provided with a connection member 250 which connects to an external insulator 25 which forms a part of a cover 20.

Figure 2A:
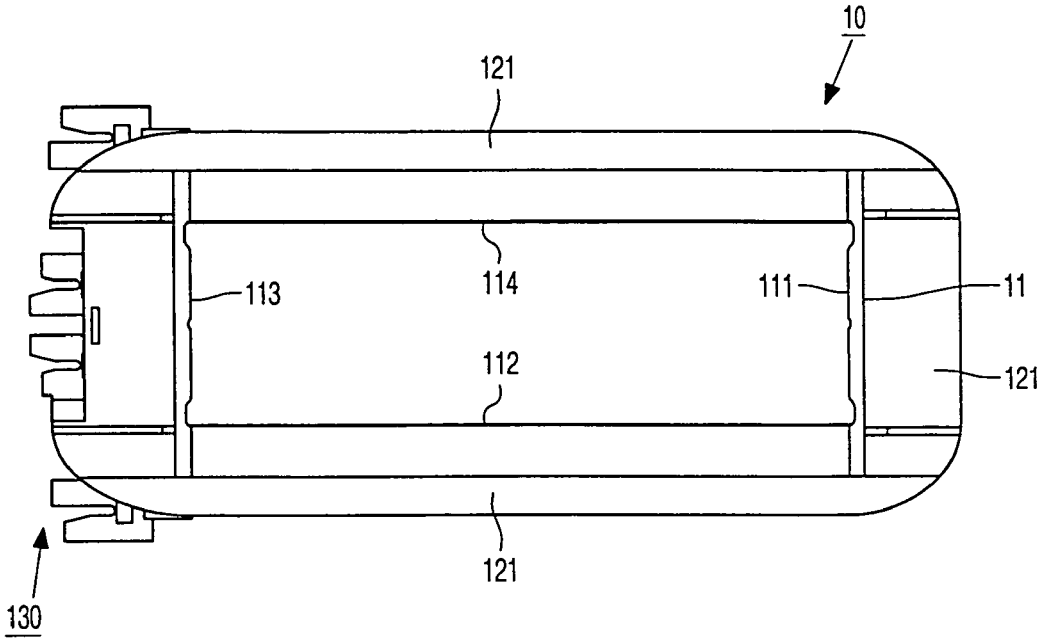
Figure 2B:
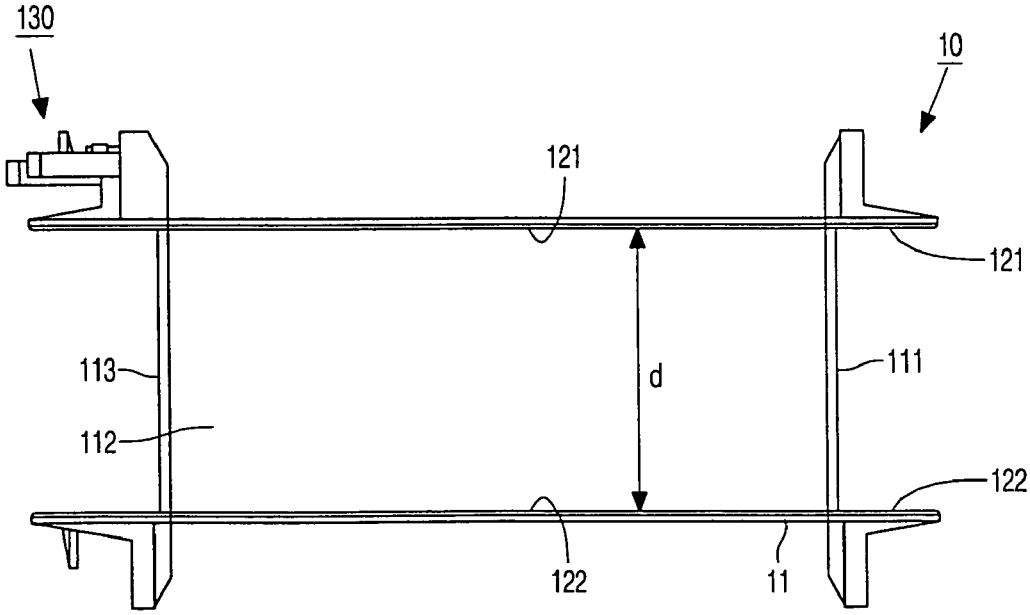

The coil comprises a synthetic resin coil base 10, shown in FIG. 2. FIG. 2A is a plan view and FIG. 2B a side view of the coil base 10. Said coil base 10 has a box-like base part 11 which comprises four faces 111, 112, 113, 114 which are arranged so as to form a rectangle for accommodating a metal core, for example an iron core, which is not shown. The synthetic resin base part is used to reel up coil windings having a width d. The base part is provided, on either side, with mutually parallel flanges 121, 122 which limit the width d of the coil windings. The coil base comprises a member 130 for forming a connection member 250 for connecting an external electrical connection.

Figure 3A:
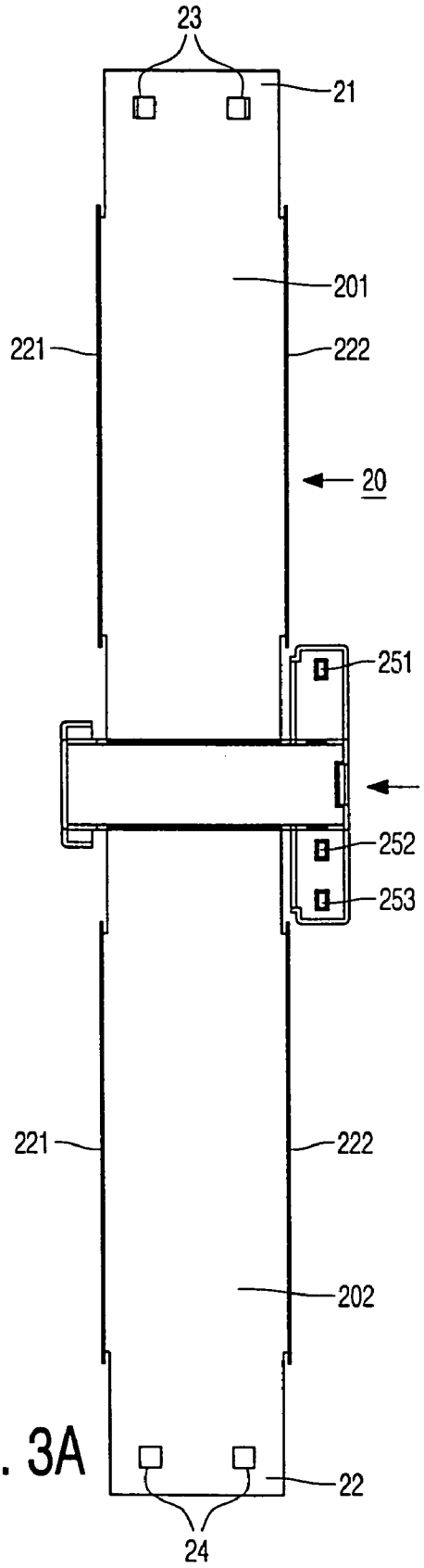
Figure 3B:
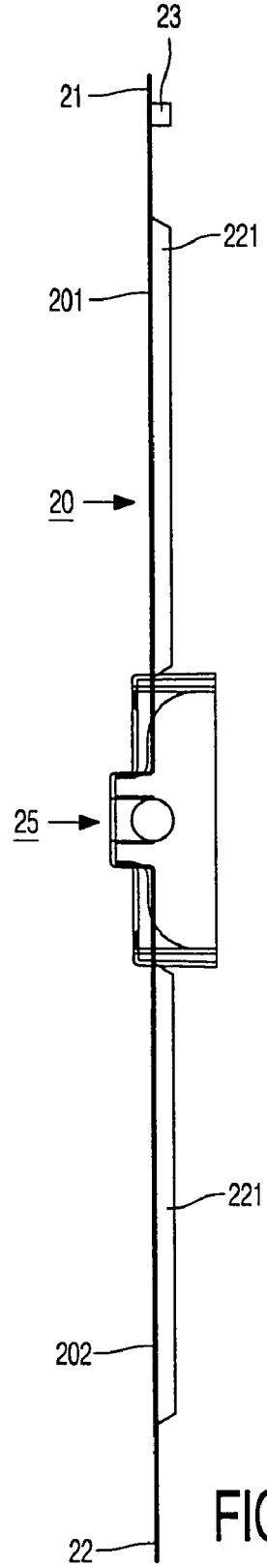

In FIGS. 1A and 1B, the coil is provided with a separate insulating synthetic resin cover 20 which is in one piece and which, in co-operation with the coil base, encloses the coil windings. The cover 20 is separately shown in FIGS. 3A and 3B. The cover is provided with a part which forms an external insulator 25 for the member 130 of the coil base, strip-shaped parts 201, 202 having ends 21, 22, respectively, extending on either side of said part. In the external insulator 25 there are connection apertures 251, 252, 253 for accommodating contact pins of external connection conductors. In the mounted state, the ends are secured to each other, preferably by means of a snap connection 23, 24. The strip-shaped parts are each provided with mutually parallel lamellae 221, 222 which co-operate with the flanges 121, 122, respectively, of the coil base. In this manner, the coil base and the cover together enclose the coil windings.

Figure 4:
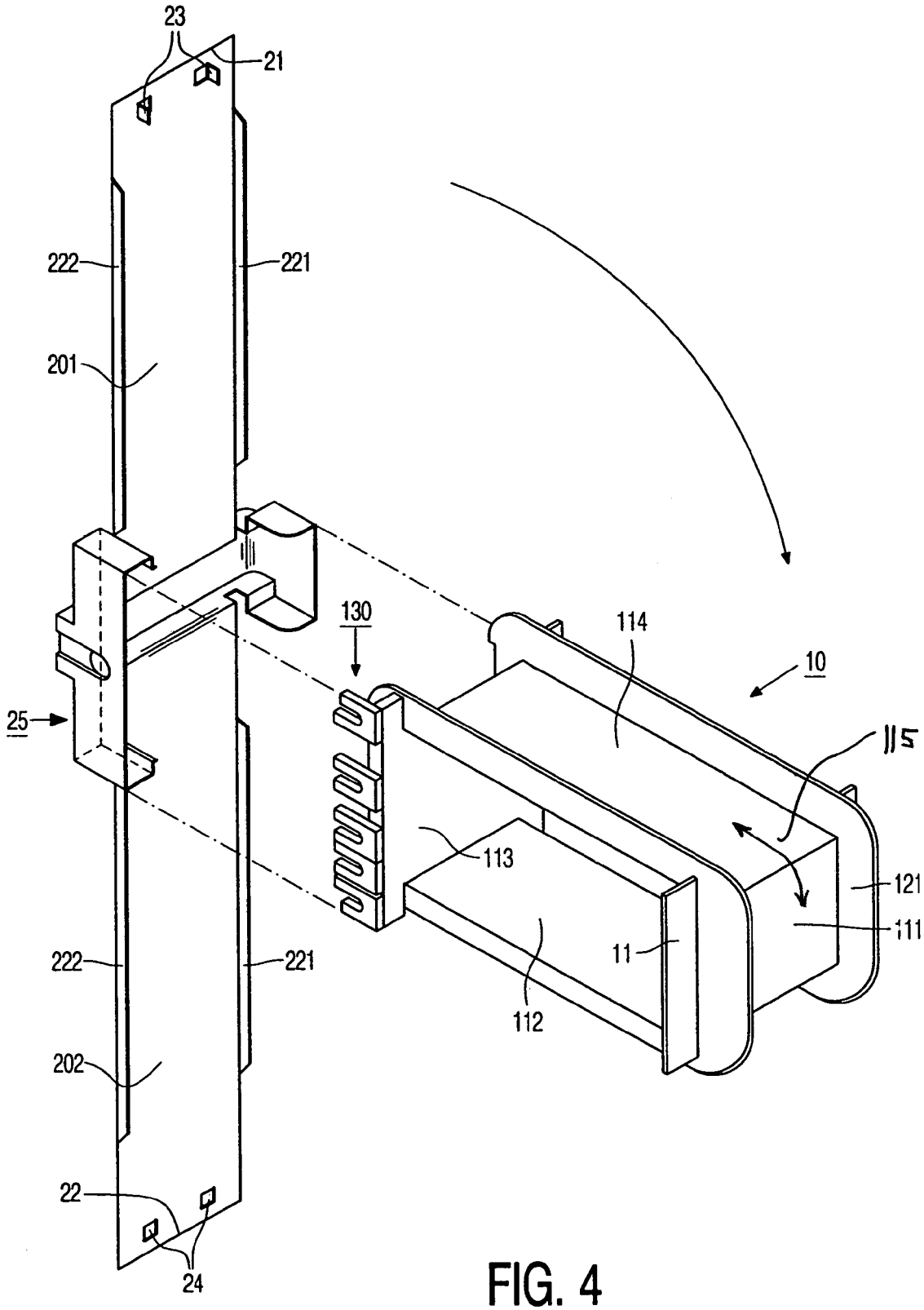
FIG. 4 is an exploded view of a synthetic resin coil base with a cover.

FIG. 4 shows the coil base 10 and the co-operating cover 20 in an exploded view. The coil windings 115 are conventional and so are only shown schematically so as not to obscure the structure of coil base 10 on which the windings are wound.

In a practical embodiment of an electric ballast in accordance with the invention, which can suitably be used to operate high-pressure sodium lamps having a rated power of 150 W, the coil is provided with high-voltage windings and supply-voltage windings. The high-voltage windings form part of a starter circuit for starting the lamp. As a result, a separate series starter coil can be dispensed with. The coil base of the ballast described is formed from glass-filled synthetic resin having a wall thickness of 1.3 mm. The high-voltage windings are provided near the faces of the base part of the coil base. The wall thickness of the base part is sufficient for obtaining the required mechanical strength of the coil base during winding of the coil windings and for achieving a sufficient electrical insulation of the high-voltage windings. The cover of this ballast is made of an unfilled synthetic resin and has a wall thickness of 0.5 mm. The small wall thickness of the cover ensures that the strip-shaped parts of the cover are sufficiently flexible and enclose the coil windings, and that they also constitute a sufficiently electrically insulating shield for the supply-voltage windings.

In a further practical embodiment of an electric ballast in accordance with the invention, the ballast can suitably be used to ignite and operate a high-pressure mercury discharge lamp. The coil of the ballast comprises only lamp supply-voltage windings.

What is claimed is:

1. An electric ballast comprising an electric coil with coil windings having a width d which are wound on a synthetic resin coil base (10) including a box-like base part comprising four faces arranged so as to form a rectangle for accommodating a metal core, said base part being provided on either side with mutually parallel flanges (121, 122) limiting the width d of the coil windings, characterized in that:

(i) the coil base (10) is provided with a connection member (250) for engaging an external electrical connector;

(ii) the ballast further comprises a separate insulating synthetic resin cover (20) which includes as a part thereof an external insulator (25) which engages said connection member (250) of the coil base (10); and (iii) the cover (20) engages the coil base (10) and cooperates therewith to substantially completely enclose the coil windings.

2. A ballast as claimed in claim 1, characterized in that the cover has end portions which connect with each other when the cover is in engagement with the coil base so as to substantially completely enclose the coil windings.

3. A ballast as claimed in claim 2, characterized in that the end portions of the cover connect with each other by one or more snap connections.

* * * * *